US011106175B1

(12) United States Patent
Tanaka

(10) Patent No.: US 11,106,175 B1
(45) Date of Patent: Aug. 31, 2021

(54) IMAGE FORMING APPARATUS HAVING A SECURING DEVICE TO SECURE A PHOTOCONDUCTOR UNIT AND A DEVELOPING UNIT

(71) Applicant: FUJIFILM Business Innovation Corp., Tokyo (JP)

(72) Inventor: Arichika Tanaka, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/924,770

(22) Filed: Jul. 9, 2020

(30) Foreign Application Priority Data

Feb. 28, 2020 (JP) ..... JP2020-033151

(51) Int. Cl.
*G03G 21/16* (2006.01)
*G03G 21/18* (2006.01)

(52) U.S. Cl.
CPC ..... *G03G 21/1647* (2013.01); *G03G 21/1676* (2013.01); *G03G 21/1825* (2013.01)

(58) Field of Classification Search
CPC ..... G03G 21/1647; G03G 21/1676; G03G 21/1817; G03G 21/1821; G03G 21/1825; G03G 2221/163; G03G 2221/1651; G03G 2221/1853
See application file for complete search history.

(56) References Cited

U.S. PATENT DOCUMENTS

2006/0051130 A1* 3/2006 Manabe ..... G03G 15/6558 399/119
2009/0297215 A1* 12/2009 Munetsugu ..... G03G 21/1825 399/111
2012/0321342 A1* 12/2012 Mori ..... G03G 21/1825 399/111
2016/0320744 A1 11/2016 Funada et al.
2017/0357210 A1* 12/2017 Inaba ..... G03G 21/1647

FOREIGN PATENT DOCUMENTS

JP 2011-150102 A 8/2011
JP 2016-206607 A 12/2016

* cited by examiner

*Primary Examiner* — Sophia S Chen
(74) *Attorney, Agent, or Firm* — Sughrue Mion, PLLC

(57) ABSTRACT

An image forming apparatus includes a photoconductor unit, a developing device, a space maintaining device, a pressing device, a securing device, and at least one connecting device. The photoconductor unit includes a photoconductor and a first part. The developing device includes a developing roller and a second part. The space maintaining device has a third part, is provided in the photoconductor unit or the developing device, and is brought into contact with the first part or the second part at the third part so as to maintain a space between the developing roller and the photoconductor. The pressing device presses the developing device toward the photoconductor unit. The securing device is removable. The at least one connecting device secures the photoconductor unit and the developing device by using the securing device so as to connect the photoconductor unit and the developing device to each other.

20 Claims, 11 Drawing Sheets

IMAGE FORMING APPARATUS HAVING A SECURING DEVICE TO SECURE A PHOTOCONDUCTOR UNIT AND A DEVELOPING UNIT

CROSS-REFERENCE TO RELATED APPLICATIONS

This application is based on and claims priority under 35 USC 119 from Japanese Patent Application No. 2020-033151 filed Feb. 28, 2020.

BACKGROUND

(i) Technical Field

The present disclosure relates to an image forming apparatus.

(ii) Related Art

As an image forming apparatus of related art, for example, the following image forming apparatus described in Japanese Unexamined Patent Application Publication No. 2016-206607 is known.

Japanese Unexamined Patent Application Publication No. 2016-206607 (for example, paragraphs 0072 to 0073 and FIGS. 1 to 6) describes an image forming apparatus in which a projection-shaped portion of a developing device is pressed by a load of a spring member, thereby the developing device is rotated about a positioning shaft toward an image holding body (photoconductor) so as to be pressed against the image holding body.

SUMMARY

Aspects of non-limiting embodiments of the present disclosure relate to an image forming apparatus that may suppress variation of a space between a developing roller and a photoconductor due to vibration compared to the case where the developing device and the photoconductor unit are not connected to each other by a removably secured connecting member.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including a photoconductor unit, a developing device, a space maintaining device, a pressing device, a securing device, and at least one connecting device. The photoconductor unit includes a photoconductor and a first part. The developing device includes a developing roller and a second part. The space maintaining device has a third part, is provided in the photoconductor unit or the developing device, and is brought into contact with the first part or the second part at the third part so as to maintain a space between the developing roller and the photoconductor. The pressing device presses the developing device toward the photoconductor unit. The securing device is removable. The at least one connecting device secures the photoconductor unit and the developing device by using the securing device so as to connect the photoconductor unit and the developing device to each other.

BRIEF DESCRIPTION OF THE DRAWINGS

Exemplary embodiments of the present disclosure will be described in detail based on the following figures, wherein.

DETAILED DESCRIPTION

Hereinafter, exemplary embodiments according to the present disclosure will be described with reference to the drawings.

First Exemplary Embodiment

Figure 1:
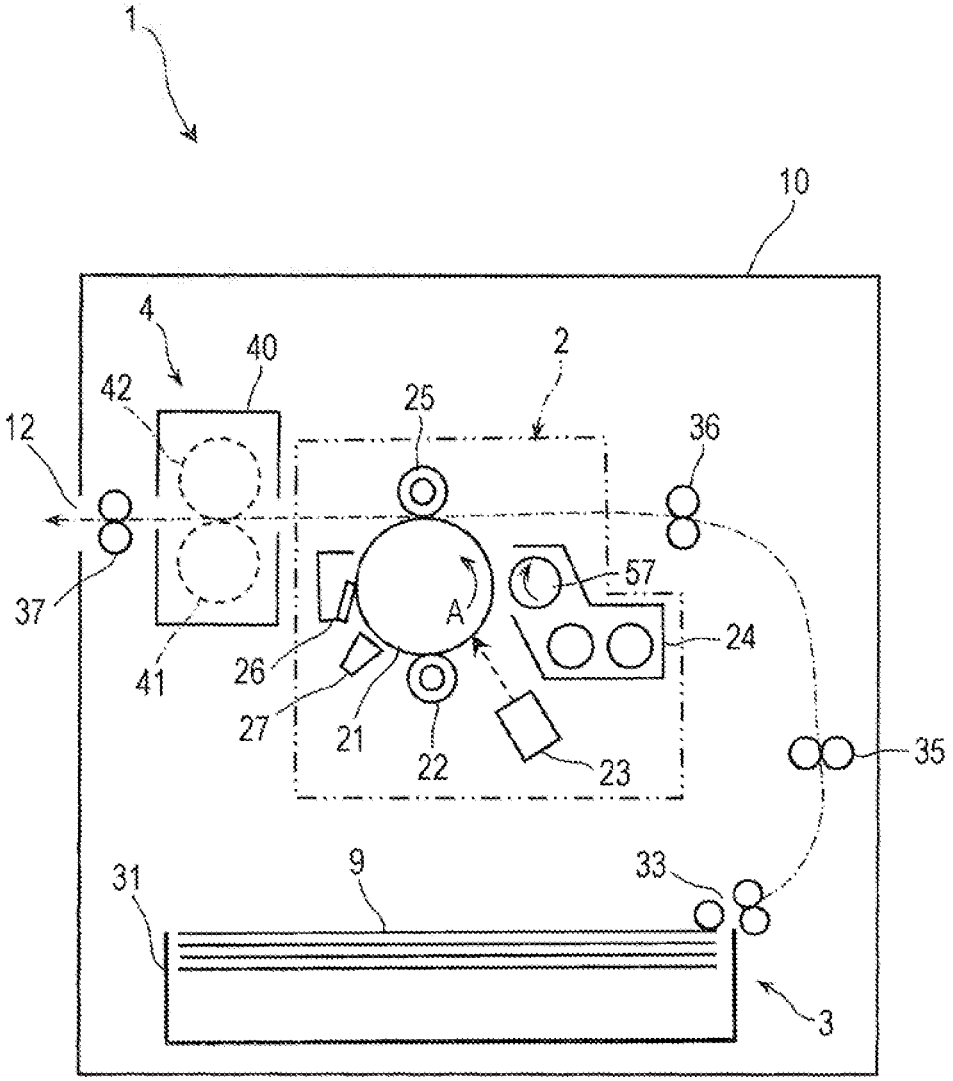
FIG. 1 is a schematic view illustrating an image forming apparatus according to a first exemplary embodiment.
Figure 2:
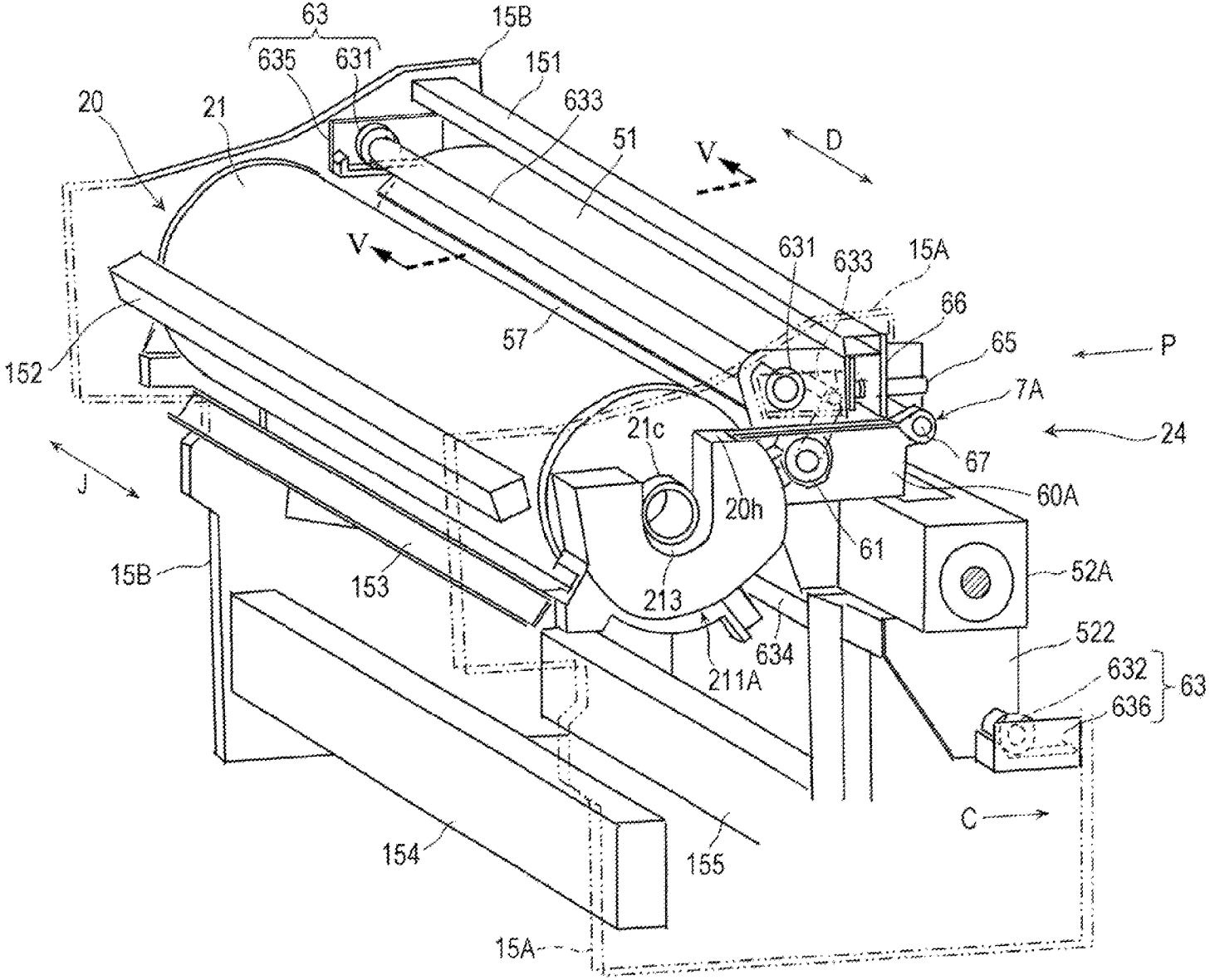
FIG. 2 is a schematic perspective view illustrating components of the image forming apparatus illustrated in FIG. 1 such as a photoconductor unit and a developing device.
Figure 3:
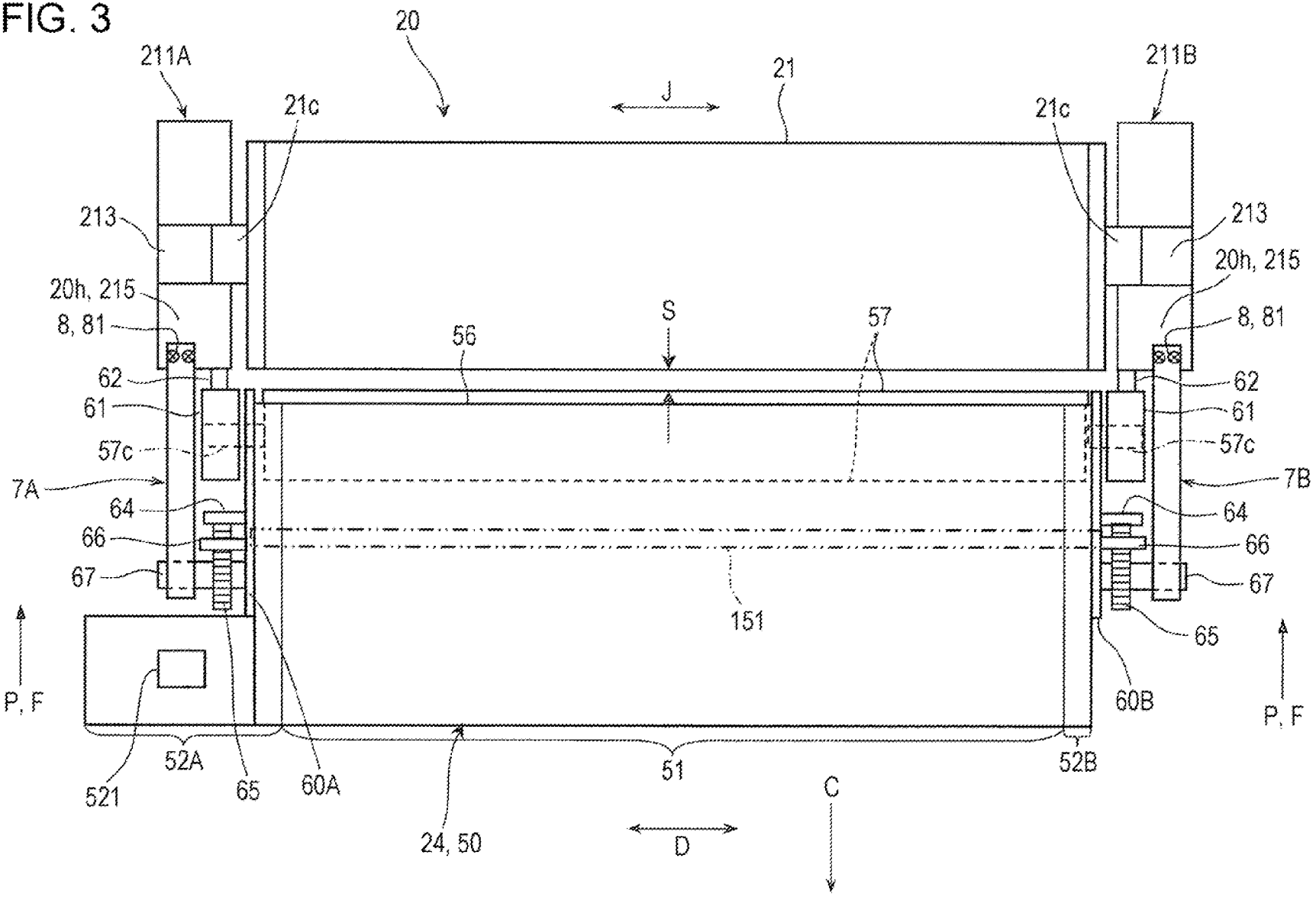
FIG. 3 is a schematic top view illustrating a state in which the photoconductor unit and the developing device illustrated in FIG. 2 are connected to each other.
Figure 4:
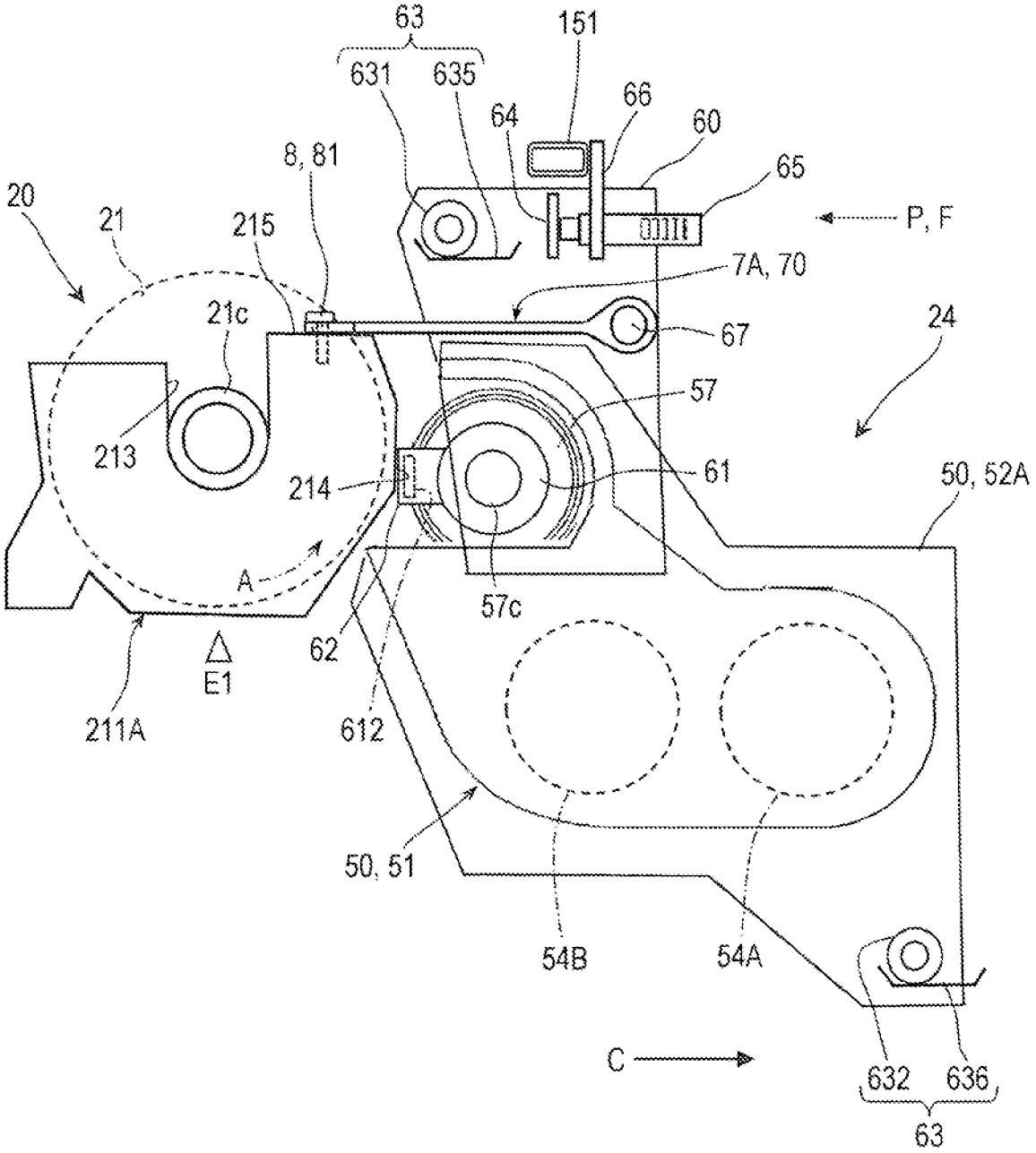
FIG. 4 is a schematic side view illustrating part of the connected state illustrated in FIG. 3.

FIGS. 1 to 4 illustrate a first exemplary embodiment according to the present disclosure. FIG. 1 illustrates an image forming apparatus 1 according to the first exemplary embodiment. FIGS. 2 to 4 illustrate a photoconductor unit and a developing device of this image forming apparatus 1.

As illustrated in FIG. 1, the image forming apparatus 1 includes an image making device 2, a sheet feed device 3, a fixing device 4, and so forth disposed in a housing 10. The image making device 2 utilizes, for example, an electrophotographic method to form a toner image formed of toner as developer and transfer the formed image onto a sheet of recording paper 9 serving as an example of a recording material. The sheet feed device 3 supplies the required recording sheet 9 contained therein to a transfer position of the image making device 2. The fixing device 4 fixes the toner image having been transferred onto the recording sheet 9.

As illustrated in FIG. 1, the image making device 2 includes devices such as a charger 22, an exposure device 23, a developing device 24, a transfer device 25, a cleaner 26, and a static eliminator 27 disposed in this order around a photoconductor drum 21 to be rotated in a direction indicated by arrow A. The photoconductor drum 21 serves as an example of a photoconductor.

Among these, the photoconductor drum 21 is a photoconductor in the form of a drum and has a photosensitive layer on a circumferential surface thereof. In addition, the photoconductor drum 21 is rotatably supported by a support frame or the like (not illustrated) and receives power from a drive device (not illustrated) so as to be rotated in the arrow A direction. The charger 22 charges the circumferential surface of the photoconductor drum 21 (image forming region) to a required polarity and potential by using a charging member to which a charging bias is supplied.

The exposure device 23 radiates light corresponding to image information (signal) input to the image forming apparatus 1 by various methods to the charged circumferential surface of the photoconductor drum 21 so as to form an electrostatic latent image. The developing device 24 supplies the toner as the developer onto the photoconductor drum 21 by using a developing roller 57, thereby developing the electrostatic latent image on the photoconductor drum 21 so as to obtain a toner image. The details of the developing device 24 will be described later.

The transfer device 25 electrostatically transfers the toner image on the photoconductor drum 21 onto the recording sheet 9 by using a transfer member to which a transfer bias is supplied. The cleaner 26 cleans the circumferential surface of the photoconductor drum 21 by removing undesired substances such as toner adhering to and remaining on the circumferential surface of the photoconductor drum 21. The static eliminator 27 removes static charge from the circumferential surface of the photoconductor drum 21 having been cleaned.

The sheet feed device 3 includes, for example, sheet containers 31 and a feeding device 33. The sheet containers 31 each contains a plurality of recording sheets 9 of required size, type, and the like used for image formation such that the recording sheets 9 are stacked one on top of another in the sheet container 31. The feeding device 33 feeds the recording sheets 9 contained in the sheet containers 31 one sheet after another.

The sheet containers 31 are attached such that the sheet containers 31 are able to be kept drawn from the housing 10, and a plurality of the sheet containers 31 are provided corresponding to form of use of the sheet containers 31. As the recording sheet 9, for example, a recording medium such as plain paper, coated paper, cardboard, or thin paper cut into a specified size is used.

The fixing device 4 includes fixing members such as a heating rotating body 41 and a pressure rotating body 42 in the form of a roller, a belt, or the like disposed in a housing 40 having an entrance opening and an exit opening for the recording sheet 9.

The heating rotating body 41 and the pressure rotating body 42 are supported so as to be rotated while in contact with each other. This contact portion serves as a fixing process portion that performs a required fixing process (heating, applying pressure) while pinching the recording sheet 9 onto which the unfixed toner image has been transferred and allowing this recording sheet 9 to pass therethrough.

Image forming is performed by the image forming apparatus 1 as follows. Herein, the image forming is exemplified by a basic image forming operation for forming an image on one side of the recording sheet 9 for description.

Upon reception of a command (signal) requesting an image forming operation from an externally connected device by a controller (not illustrated) of the image forming apparatus 1, in the image making device 2, the photoconductor drum 21 starts to be rotated in the arrow A direction, the charger 22 charges the circumferential surface of the photoconductor drum 21 to the specified polarity (minus polarity in the present example) and potential, and then, the exposure device 23 radiates the light to the charged circumferential surface of the photoconductor drum 21 based on the image information having been input to the exposure device 23. Thus, the electrostatic latent image of a required pattern is formed.

Next, in the image making device 2, the developing device 24 supplies the toner charged to a required polarity (minus polarity in the present example) from the developing roller 57 toward the electrostatic latent image formed on the circumferential surface of the photoconductor drum 21, thereby developing the electrostatic latent image to make the electrostatic latent image visible. Thus, a toner image is formed on the photoconductor drum 21.

Then, in the image making device 2, the photoconductor drum 21 being rotated transports the toner image to the transfer position facing the transfer device 25.

Meanwhile, in the sheet feed device 3, the feeding device 33 feeds the recording sheet 9 to a supply transport path that includes transport rollers 35, 36, a sheet guide portion, and the like, and at last, the recording sheet 9 is fed to the transfer position of the image making device 2 by the transport rollers 36 so as to be supplied in time for timing at which the toner image formed by the image making device 2 reaches the transfer position.

At the transfer position in the image making device 2 at this time, the transfer member of the transfer device 25 forms a transfer electric field between the transfer member and the photoconductor drum 21 so as to transfer the toner image on the photoconductor drum 21 to one side of the recording sheet 9. Also in the image making device 2, during a time of the image forming operation including the time after this transference, the cleaner 26 continues to clean the circumferential surface of the photoconductor drum 21, and the static eliminator 27 removes the static charge from the photoconductor drum 21 having been cleaned. Thus, the photoconductor drum 21 is kept ready for an operating step of the next image formation.

Next, the recording sheet 9 onto which the toner image has been transferred is fed from the transfer position and transported toward the fixing device 4. In the fixing device 4, the recording sheet 9 is introduced into and caused to pass through the fixing process portion between the heating rotating body 41 and the pressure rotating body 42 being rotated. While the toner image is passing through the fixing process portion, the toner included in the toner image is heated under pressure so as to be fused, thereby the toner image on the one side of the recording sheet 9 is fixed to the recording sheet 9.

Furthermore, the fixing device 4 feeds the recording sheet 9 having undergone the fixing from the fixing process portion to an output transport path that includes output rollers 37, a sheet guide portion, and the like. At last, the recording sheet 9 after the fixing is output through an output opening 12 of the housing 10 by the output rollers 37 in the output transport path so as to be contained in an output container portion (not illustrated).

Thus, a monochrome image including the toner of a single color has been formed on the one side of a single recording sheet 9, and the image forming operation for the one side of the recording sheet 9 is completed. When a command for execution of the image forming operation on a plurality of sheets is issued, the above-described series of operations are similarly repeated as many times as the number of the sheets.

Next, the photoconductor drum 21 and the developing device 24 of this image forming apparatus 1 are further described.

As illustrated in FIGS. 2 to 4, the photoconductor drum 21 has left and right shaft portions 21*c* projecting from both ends in an axial direction J thereof.

The photoconductor drum 21 is combined with other elements such as left and right shaft support portions 211A, 211B serving as examples of support devices by which the left and right shaft portions 21*c* of the photoconductor drum 21 are respectively rotatably supported, thereby becoming part of a single unit that is a photoconductor unit 20.

The left and right shaft support portions 211A, 211B each have a support groove 213, a positioning portion, a contact surface 214, a securing surface 215, and so forth. The recessed support grooves 213 respectively allow the left and right shaft portions 21*c* of the photoconductor drum 21 to be fitted thereinto so as to support the shaft portions 21*c*. The contact surface 214 will be described later.

Furthermore, as illustrated in FIG. 2, the photoconductor unit 20 is mounted such that, in the housing 10, the position of the photoconductor unit 20 is fixed to drawing frames 15A, 15B disposed so as to be externally drawable with the left and right shaft support portions 211A, 211B interposed between the photoconductor unit 20 and the drawing frames 15A, 15B. The drawing frames 15A, 15B are connected to, for example, a plurality of connecting members 151 to 155 or the like to serve as a three-dimensional drawing movement body and supported by movement devices such as movement rails (not illustrated) so as to be movable relative to the housing 10.

The photoconductor unit 20 is mounted by being held in a state in which the photoconductor drum 21 is positioned to a reference position E1 relative to the drawing movement body including, for example, the drawing frames 15A, 15B. Furthermore, the drawing frames 15A, 15B or the like have, for example, positioning pins 16 (see FIG. 11) that are used for positioning by being fitted into a positioning holes provided on a mounting portion side when the drawing frames 15A, 15B are retracted into the mounting portion of the housing.

Meanwhile, as illustrated in, for example, FIGS. 1 to 5, the developing device 24 includes a housing 50 in which developer 18 is contained and the developing roller 57 and the like are disposed. As the developer 18, for example, two-component developer that includes non-magnetic toner and magnetic carrier is used.

Figure 5:
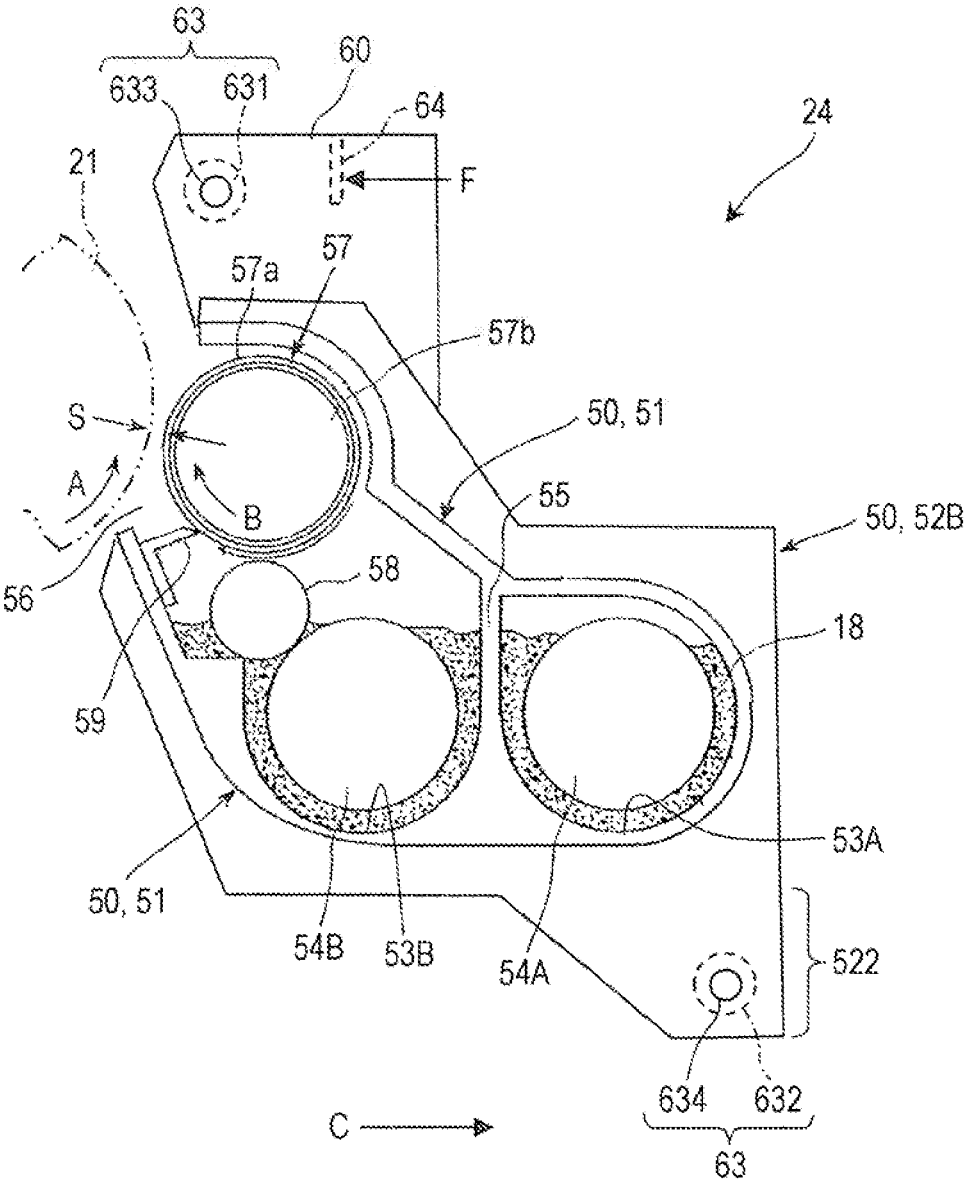
FIG. 5 is a schematic sectional view of the developing device taken along line V-V illustrated in FIG. 2.

As illustrated in FIG. 5, the housing 50 has two groove-shaped paths 53A, 53B as a container portion 51 that extend in the longitudinal direction D (for example, FIG. 3) so as to be parallel to each other and are connected to each other at both ends in the longitudinal direction.

Transport members 54A, 54B such as screw augers are disposed in the container portion 51 of the housing 50. The transport members 54A, 54B are rotated in the paths 53A, 53B, respectively, so as to agitate and transport the developer 18 in the longitudinal direction D. The paths 53A, 53B except for the end portions in the longitudinal direction D are kept separated by a separation wall 55 that extends in the longitudinal direction D.

In the paths 53A, 53B, when the transport members 54A, 54B are rotated, the developer 18 is transported in opposite transport directions through the paths 53A, 53B. Then, at a downstream end portion in each transport direction, the developer 18 moves so as to be fed to an upstream end portion of another of the paths 53A, 53B in the corresponding transport direction, thereby, as a whole, the developer 18 is transported so as to be circulated.

Furthermore, as illustrated in FIG. 5, the housing 50 has a developing opening 56 at a portion thereof facing a developing target portion of the photoconductor drum 21 in the axial direction J (for example, FIG. 3).

The developing roller 57 is disposed on an inner side of the housing 50 including the developing opening 56. The developing roller 57 is rotated while passing through the developing opening 56 so as to be exposed to the outside.

A supply member 58 and a layer thickness adjusting member 59 are disposed near the developing opening 56 on the inner side of the housing 50. The supply member 58 includes a paddle or a roller that is rotated and supplies part of the developer 18 transported by the transport member 54B through the paths 53B to the developing roller 57 so as to pass the part of the developer 18 to the developing roller 57. The layer thickness adjusting member 59 having a plate shape adjusts the thickness of a layer of the developer held by the developing roller 57.

Furthermore, as illustrated in FIG. 3, in the housing 50, both end portions of the container portion 51 in the longitudinal direction D are configured as left and right support portions 52A, 52B.

The left and right support portions 52A, 52B support both end portions (including bearings or the like) of each of the transport members 54A, 54B, the developing roller 57, the supply member 58, the layer thickness adjusting member 59, and so forth in the longitudinal direction D and are used as portions in which a drive transmission mechanism and the like (not illustrated) are disposed and contained. The left support portion 52A has a replenishment path projecting therefrom. The replenishment path has an inlet 521. The developer (such as toner) with which the developing device 24 is replenished is taken in through the inlet 521.

Furthermore, as illustrated in, for example, FIGS. 2 to 4, left and right support plates 60A, 60B are respectively attached to outer surface portions of the left and right support portions 52A, 52B so as to project upward from the housing 50 for providing, for example, a movement support device 63, which will be described later, and left and right lower projections 522 that project to the lower side of the housing 50 are respectively provided in lower end portions of the left and right support portions 52A, 52B. Instead of the lower projections 522 provided in the support portions 52A, 52B, support plates attached to the outer surface portions of the support portions 52A, 52B may be used as the lower projections 522.

As illustrated in FIG. 5, for example, a roller including a cylindrical (non-magnetic) sleeve 57*a* to be rotated in a direction indicated by arrow B and a magnet roller 57*b* disposed in a hollow space in the sleeve 57*a* is used for the developing roller 57. The developing roller 57 is supported by bearings at shaft portions 57*c*.

Figure 7:
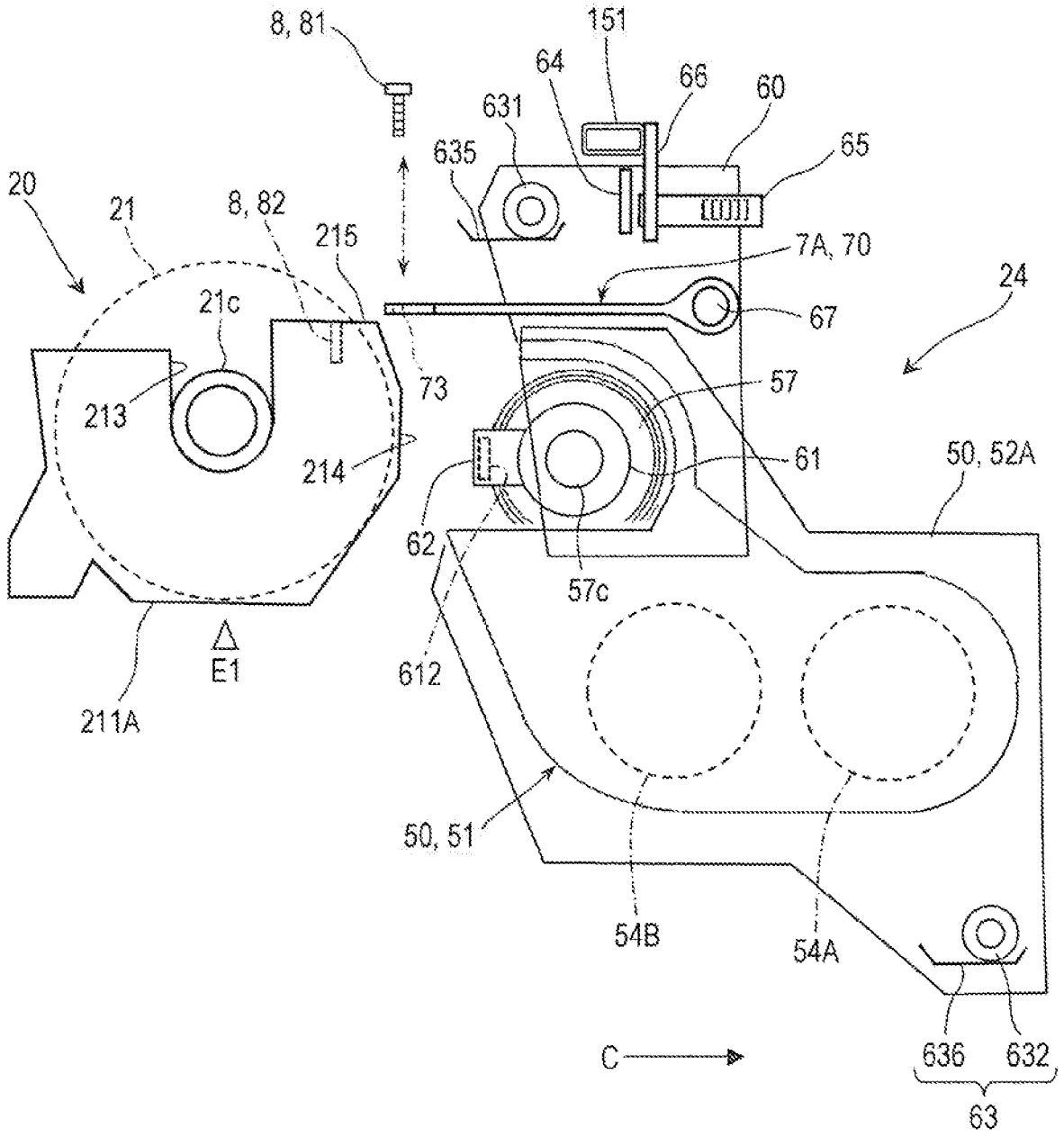
FIG. 7 is a schematic side view illustrating part of the connection released state illustrated in FIG. 6.

A space S between the developing roller 57 and the photoconductor drum 21 is maintained at a fixed distance when, as illustrated in, for example, FIGS. 3 and 4, contact portions 62 are brought into contact with contact surfaces 214 (see FIGS. 3 and 4) of the shaft support portions 211A, 211B. The contact portions 62 become parts of space maintaining members 61. Each of the space maintaining members 61 serves as an example of a space maintaining device and is attached to a corresponding one of the shaft portions 57*c*. The shaft support portions 211A, 211B support the shaft portions 21*c* of the photoconductor drum 21. Furthermore, as illustrated in FIGS. 4 and 7, the space maintaining members 61 include adjusting devices 612 that adjust the space S. The following type of a structure is used as each adjusting device 612: a sheet-shaped spacer member having a predetermined thickness is appropriately selected, and the spacer member is mounted to or removed from a mounting portion for the spacer member so as to allow, for example, a projecting position of a contact portion 62 (distance from the shaft portion 57*c*) to be finely varied.

Furthermore, when a predetermined point of time of the image forming operation or the like has been reached, a developing bias is supplied from a power supply unit (not illustrated) to the shaft portions 57*c* of the developing roller 57 so as to form a developing electric field between the developing roller 57 and the photoconductor drum 21.

Furthermore, as illustrated, for example, in FIGS. 2 to 4, 6, and 7, the developing device 24 is supported by the movement support device 63 so as to be movable in a direction C in which the developing device 24 is separated from the photoconductor drum 21 of the photoconductor unit 20.

As illustrated in, for example, FIG. 4, the movement support device 63 includes upper and lower wheels 631, 632 and upper and lower guide rails 635, 636. Each of the upper wheels 631 is provided on a corresponding one of the left and right end portion sides in the longitudinal direction D of the housing 50. Each of the lower wheels 632 is provided on a corresponding one of the left and right end portion sides in the longitudinal direction D of the housing 50. Each of the upper guide rails 635 is provided in a corresponding one of the drawing frames 15A, 15B, and each of the lower guide rails 636 is provided in a corresponding one of the drawing frames 15A, 15B. The upper and lower guide rails 635, 636 guide the upper and lower wheels 631, 632 and allow the upper and lower wheels 631, 632 to move (roll) in the separation direction indicated by arrow C.

For example, as illustrated in, for example, FIG. 4, the upper wheels 631 are rotatably attached to both end portions of an upper support shaft 633. The upper support shaft 633 penetrates through the left and right support plates 60A, 60B in the housing 50 in the longitudinal direction D, projects from outer sides of the support plates 60A, 60B by a predetermined amount, and is secured to the outer sides of the support plates 60A, 60B. For example, as illustrated in, for example, FIG. 4, the lower wheels 632 are rotatably attached to a lower support shaft 634. The lower support shaft 634 penetrates through the left and right lower projections 522 in the housing 50, projects from outer sides of the lower projections 522 by a predetermined amount, and is secured to the outer sides of the lower projections 522.

Meanwhile, the upper and lower guide rails 635, 636 each include a member provided with a rail portion that allows a corresponding one of the wheels 631, 632 to roll thereon and guides the corresponding one of the wheels 631, 632 in the separation direction C. The separation direction C is set, for example, in the horizontal direction (a direction substantially parallel to a floor surface where the image forming apparatus 1 is installed).

With the movement support device 63, the developing device 24 is, as illustrated in, for example, FIG. 2, supported in a state in which the developing device 24 is placed on the drawing movement body including the drawing frames 15A, 15B and the like with the movement support device 63 interposed therebetween.

Thus, when the drawing movement body is drawn from the housing 10, the developing device 24 is able to be set in a state in which the developing device 24 has been drawn to the outside of the housing 10 together with the drawing movement body.

Figure 6:
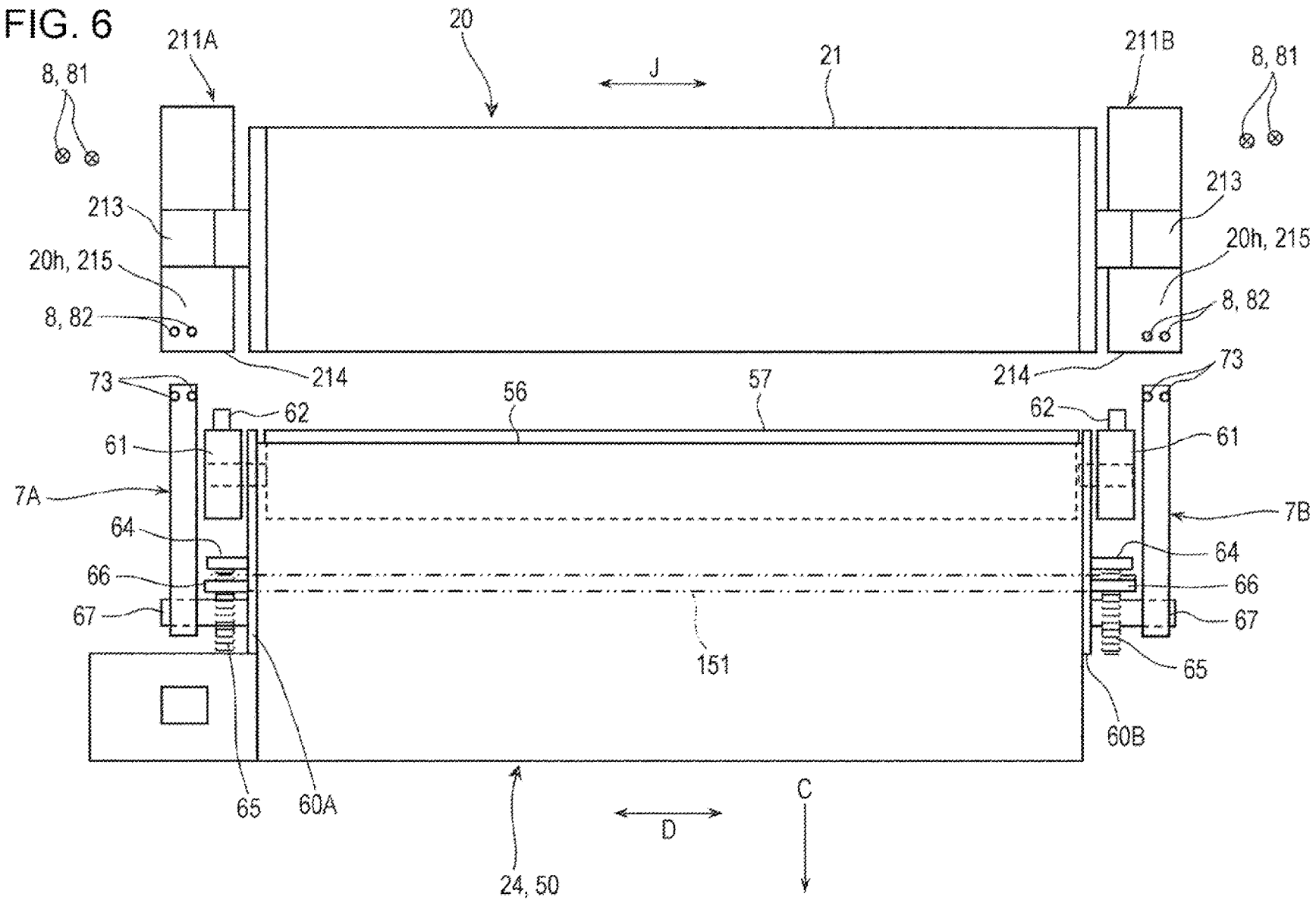
FIG. 6 is a schematic top view illustrating a state in which the connection between the photoconductor unit and the developing device illustrated in FIG. 2 is released.

As illustrated in, for example, FIGS. 6 and 7, the developing device 24 is also able to be set in a state in which the developing device 24 has moved in the direction C indicated by the arrow in the drawing movement body so as to be kept separated from the photoconductor drum 21 of the photoconductor unit 20 when the upper and lower wheels 631, 632 in the movement support device 63 move due to rolling of the upper and lower wheels 631, 632 respectively on the upper and lower guide rails 635, 636.

Furthermore, as illustrated in, for example, FIGS. 2 to 4, the developing device 24 is pressed toward (the photoconductor drum 21 of) the photoconductor unit 20 by pressing devices 65.

With the pressing devices 65 according to the first exemplary embodiment, pressure members pressed out by pressure springs provided at the connecting member 151 in the drawing frames 15A, 15B are brought into contact with and press at a required pressure F pressure receiving plates 64 provided in the left and right support plates 60A, 60B in the housing 50. The pressing devices 65 are attached to attachment plates 66 that are provided so as to hang at respective end portions of the connecting member 151 such that the pressure members are able to be brought into contact with the pressure receiving plates 64. As illustrated in, for example, FIG. 11, the attachment plates 66 are securely fixed to the respective end portions of the connecting members 151 by a securing method using, for example, screws 68 and disposed such that the attachment plates 66 exist at positions opposite the photoconductor drum 21 relative to the respective pressure receiving plates 64 so as to be kept separated from the pressure receiving plates 64 by a predetermined distance.

Furthermore, a pressing direction P in which the pressing devices 65 is pressed is set in, for example, as illustrated in, for example, FIG. 4, a direction parallel to and opposite to the direction C in which the developing device 24 is separated by the movement support device 63.

With the pressing devices 65, as illustrated in FIGS. 3 and 4, the pressure receiving plates 64 of the developing device 24 receive the pressure F in the pressing direction P from the pressing devices 65, thereby the developing device 24 is maintained in a state in which the developing device 24 is pressed toward the photoconductor unit 20.

Thus, in the developing device 24, the contact portions 62 of the space maintaining members 61 in the developing roller 57 are pressed against the contact surfaces 214 of the respective shaft support portions 211A, 211B by a force based on the pressure F. As a result, as illustrated in FIGS. 3 and 5, the space S between the developing roller 57 of the developing device 24 and the photoconductor drum 21 is maintained at a wished distance set by the space maintaining members 61.

As illustrated in FIGS. 2 to 4, in this image forming apparatus 1, the photoconductor unit 20 and the developing device 24 are connected to each other by removably secured connecting devices 7.

According to the first exemplary embodiment, as illustrated in FIG. 3, left and right end portions of the photoconductor unit 20 in the longitudinal direction D (direction along the axial direction J of the photoconductor drum 21) and left and right end portions of the developing device 24 in the longitudinal direction are respectively connected to each other by two connecting devices 7A, 7B.

As illustrated in, for example, FIGS. 2 to 4 and 8, the connecting devices 7A, 7B include respective members 70. Each of the members 70 is in the form of a plate elongated in a single direction. A first end portion 70*a* of the member 70 in the elongated direction is pivotally attached to the developing device 24. A second end portion 70*b* of the member 70 is secured to a corresponding one of securing portions 20*h* of the photoconductor unit 20 by a removable securing device 8.

The members 70 included in the connecting devices 7A, 7B are produced from a material having a sufficient strength to maintain a state in which the photoconductor unit 20 and the developing device 24 are connected to each other.

Figure 8A:
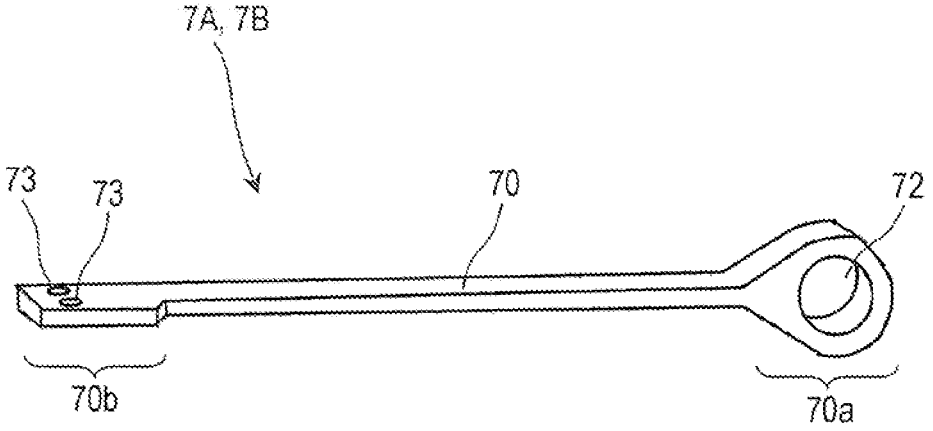
FIG. 8A is a schematic perspective view of a connecting device.
Figure 8B:
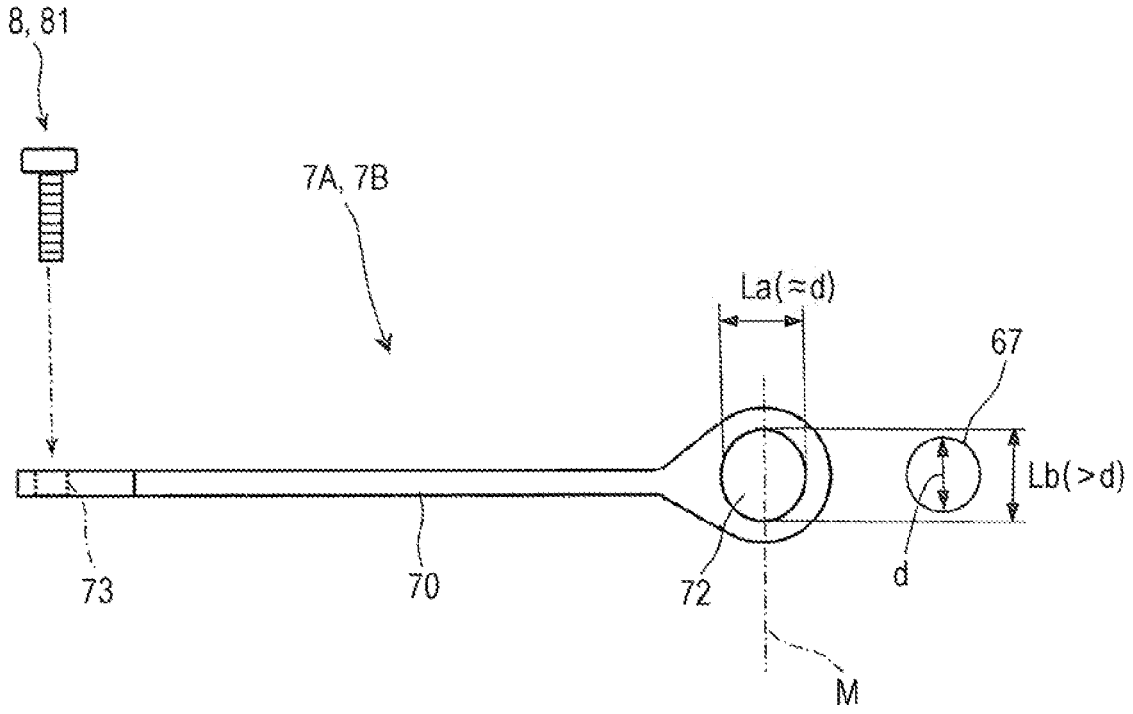
FIG. 8B is a schematic view illustrating a structure of the connecting device.

As illustrated in, for example, FIGS. 8A and 8B, the first end portion 70*a* of the member 70 of each of the connecting devices 7A, 7B has an attachment hole 72 used to pivotally attach the member 70 to a corresponding one of attachment shaft 67 provided in the developing device 24.

The attachment shafts 67 are provided in the left and right support plates 60A, 60B in the developing device 24 so as to project outward by a predetermined length in the substantially horizontal direction. It is sufficient that each of the attachment shafts 67 be a member in which at least a portion onto which the attachment hole 72 is fitted and attached has a cylindrical shape. For example, the attachment shaft 67 may be provided as a stud.

As illustrated in FIG. 8A, the attachment hole 72 is provided as a through hole that extends in a direction substantially perpendicular to the elongated direction of the plate-shaped member 70 and in a direction parallel to a plate surface of the plate-shaped member 70. The attachment hole 72 extends in the substantially horizontal direction when attached to the attachment shaft 67.

Furthermore, the attachment hole 72 is formed as a long hole as illustrated in FIG. 8B. It is sufficient that a long direction M of the long hole of the attachment hole 72 be a direction able to be displaced in a direction in which unnecessary inclination occurring between the photoconductor unit 20 and the securing portion 20*h* when the connecting devices 7A, 7B are secured is suppressed (see FIG. 9B).

According to the first exemplary embodiment, a long direction M of the long hole of the attachment hole 72 is set in a direction substantially perpendicular to the elongated direction of the member 70 of the connecting devices 7A, 7B. Accordingly, the attachment hole 72 according to the first exemplary embodiment is generally formed as a long hole elongated in the longitudinal direction.

Specifically, the attachment hole 72 is formed as a long hole in which a diameter La in the transverse direction along the elongated direction of the member 70 is made to be substantially equal in dimension to a diameter d of a circle in section of the attachment portion of the attachment shaft 67 and a diameter Lb in the longitudinal direction along a direction substantially perpendicular to the elongated direction of the member 70 is greater in dimension than the diameter d of the attachment shaft 67 by a required amount.

When the displacement of the attachment hole 72 relative to the attachment shaft 67 is allowed more than required, an attachment state may become unstable. Accordingly, the diameter Lb in the longitudinal direction that is a longer diameter of the long hole is greater in dimension than the diameter d of the attachment shaft 67 by a minimum required length. The diameter Lb being the longer diameter at this time is greater in dimension than the diameter d of the attachment shaft 67 by, for example, about 0.5 to 5 mm.

The securing device 8 is a device for which a removing operation after securing is comparatively easily performed. For example, a fitting device in which a projection 81 and a fitting hole 82 are removably fitted is employed as the securing device 8.

The securing device 8 including the fitting device according to the first exemplary embodiment uses a structure in which a screw as the projection 81 and a threaded hole as the fitting hole 82 into which the screw serving as the projection 81 is screwed are combined. Although the securing device 8 may be the fitting device including a pair of the projection 81 and the fitting hole 82, from the viewpoint of stable securing, a fitting device including a plurality of pairs of projections 81 and fitting holes 82 may be employed. According to the first exemplary embodiment, for example, a fitting device including two pairs of the projections 81 (screw) and the fitting holes 82 (threaded hole) is employed.

Figure 10:
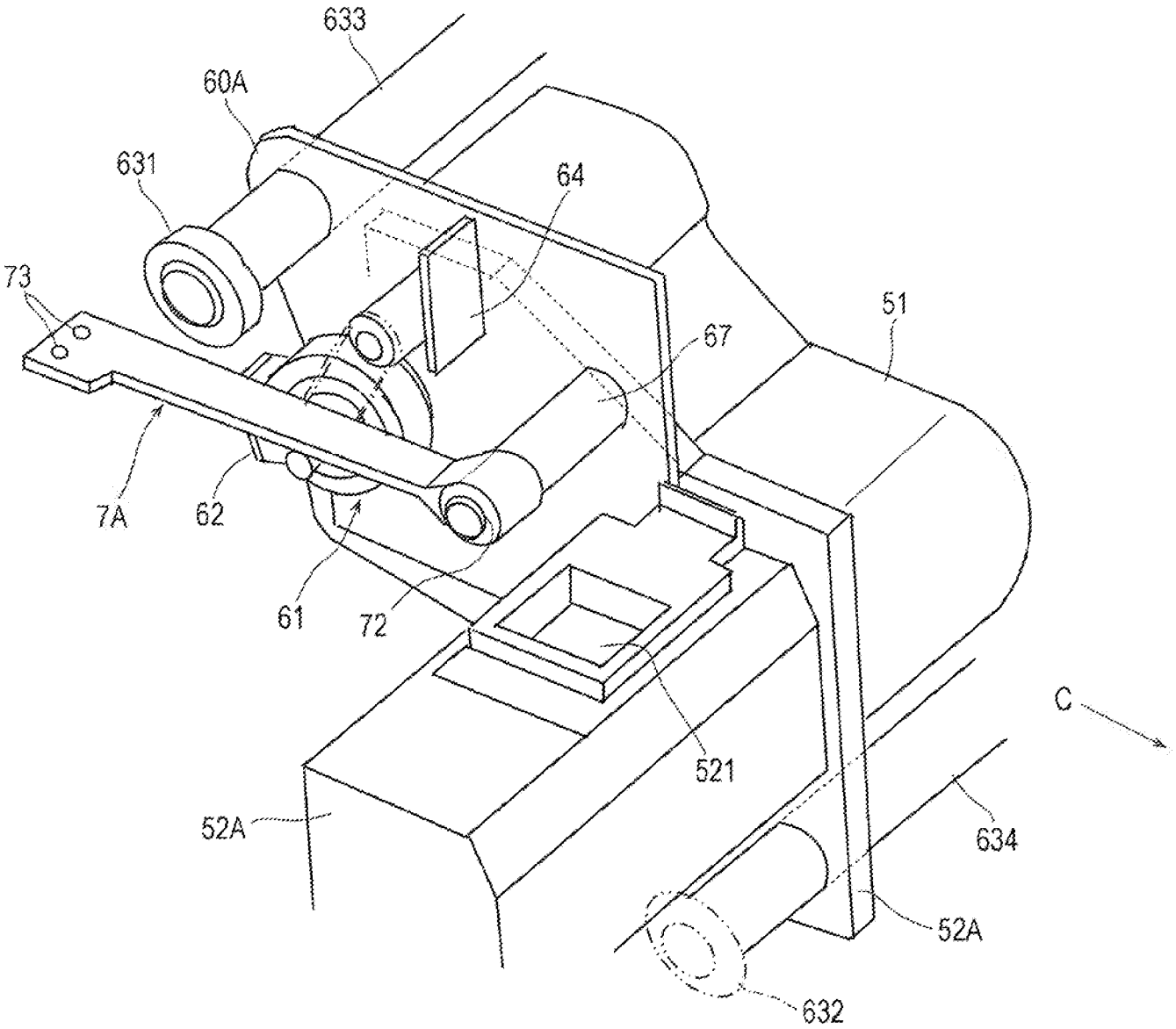
FIG. 10 is a schematic perspective view illustrating a state in which the connecting device is attached to the developing device.

As illustrated in, for example, FIGS. 8A, 8B, and 10, as the securing device 8, two pairs of screws and threaded holes are employed. Thus, two unthreaded holes 73 through which two screws as projections 81 are inserted are provided in the second end portion 70*b* of each of the members 70 of the connecting devices 7A, 7B.

Although two unthreaded holes 73 are spaced from each other in a direction perpendicular to the elongated direction of the member 70, arrangement of two unthreaded holes 73 is not limited to this. The second end portion 70*b* is that of a flat plate used in the substantially horizontal direction. However, since two unthreaded holes 73 are provided so as to be spaced from each other in the above-described direction, a shape in which the width of the second end portion 70*b* is enlarged relative to the width of a body portion is employed (see FIG. 10).

As illustrated in, for example, FIGS. 2 to 4, the securing portions 20*h* of the photoconductor unit 20 to which the connecting devices 7A, 7B are removably connected employ the left and right shaft support portions 211A, 211B and include the securing surfaces 215 formed in parts of the shaft support portions 211A, 211B.

As illustrated in, for example, FIGS. 2 and 4, the securing surfaces 215 are formed as upper surfaces of portions at substantially the same height as the height of the centers of the attachment shafts 67 provided on the developing device 24 side. Furthermore, from the viewpoints of, for example, good joining to planar lower surfaces of the second end portions 70*b* of the connecting devices 7A, 7B, the securing surfaces 215 are formed as a planar smooth surfaces.

Furthermore, two threaded holes as the fitting holes 82 of the securing device 8 are provided in each of the securing surfaces 215 of the securing portion 20*h*. Two threaded holes are formed so as to be aligned with two unthreaded holes provided in each of the second end portions 70*b* of the connecting devices 7A, 7B.

Figure 9A:
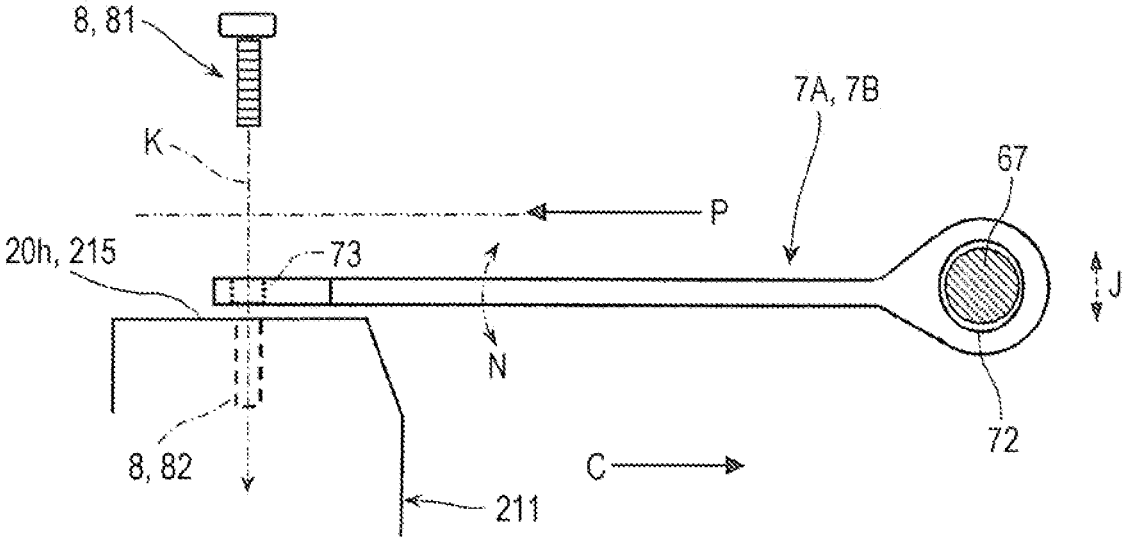
FIG. 9A is a schematic view illustrating structures of the connecting device and a securing device.
Figure 9B:
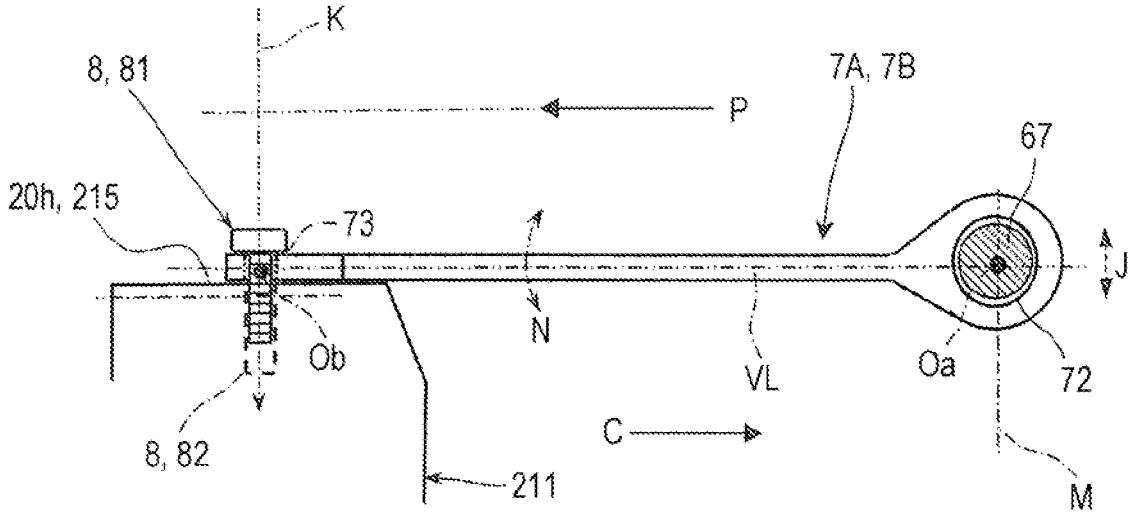
FIG. 9B is a schematic view illustrating a state and a structure in which the connecting device is secured by the securing device.

As illustrated in FIGS. 9A and 9B, regarding securing devices 8, a direction K in which the connecting devices 7A, 7B are secured intersects the pressing direction P of the pressing devices 65.

The angle of the intersection at this time may be the right angle or close to the right angle as much as possible. The perpendicular intersection refers to, for example, an intersection angles of intersection of which are within a range of 90°±5°.

According to the first exemplary embodiment, the direction of the screw holes is set such that an advancing direction in which the screws as the projections 81 are being screwed into the screw holes as the fitting holes 82 intersects (wished to perpendicularly intersect) the pressing direction P. Actually, as illustrated in FIG. 9A, the screw holes as the fitting holes 82 are provided as holes extending in a direction substantially perpendicular to the securing surfaces 215 of the securing portion 20*h*.

Furthermore, as illustrated in FIG. 9B, the direction K in which the securing device 8 is secured according to the first exemplary embodiment is in intersecting (wished to be a perpendicularly intersecting) relationship with the elongated direction of the member 70 when the connecting device 7A or 7B is secured.

Furthermore, as illustrated in FIG. 9B, each of the connecting devices 7A, 7B according to the first exemplary embodiment is configured such that the long direction M of the long hole of the attachment hole 72 is parallel to the direction K in which the securing devices 8 secures the connecting devices 7A, 7B.

Furthermore, as illustrated in FIG. 9B, each of the connecting devices 7A, 7B according to the first exemplary embodiment is configured such that a virtual line VL that passes through a center Oa of a portion for attachment to the developing device 24 (attachment shaft 67) and a center Ob of a portion secured to the securing portion 20*h* (second end portion 70*b*) is parallel to the direction C of the separation due to the movement by using the movement support device 63.

As illustrated in, for example, FIG. 10, the connecting devices 7A, 7B having been described are each mounted in advance on the developing device 24 side, for example, as follows, so as to be easily usable when the connection is required: that is, the attachment hole 72 of the first end portion 70*a* is fitted onto the attachment shaft 67 at a corresponding one of the end sides of the developing device 24 in the longitudinal direction D so as to attach the connecting device 7A or 7B to the attachment shaft 67, and the second end portion 70*b* is maintained in a free state.

In this case, for example, a retaining member such as an E-shaped ring (not illustrated) is mounted on one side or both sides of a portion of the attachment shaft 67 where the attachment hole 72 of the connecting device 7A or 7B is fitted. Thus, the attachment positions of the connecting devices 7A, 7B to the attachment shafts 67 may be held, and removal of the connecting devices 7A, 7B from the attachment shafts 67 may be suppressed.

Furthermore, since the connecting devices 7A, 7B are pivotal about the attachment shafts 67 at this time, as the pivot as illustrated in, for example, FIGS. 9A and 9B, the connecting devices 7A, 7B are swingable in the up-down direction as indicated by double-headed arrow N about the attachment shafts 67. Accordingly, although it actually depends on variation in ease of pivoting, the connecting devices 7A, 7B not in use may be oriented such that the second end portions 70*b* are slightly move down. In contrast, the orientation of the connecting devices 7A, 7B is adjustable by arbitrarily swinging the connecting devices 7A, 7B in the up-down direction about the attachment shafts 67 as the pivot.

Furthermore, since the attachment holes 72 of the connecting devices 7A, 7B are the long holes, the connecting devices 7A, 7B at this time are able to be slightly displaced in both directions along the long direction M of the long holes. This allows the positions of the connecting devices 7A, 7B to be adjusted by displacing the long holes in the long direction M.

The photoconductor unit 20 and the developing device 24 are connected to each other by the connecting devices 7A, 7B as follows.

First, the developing device 24 supported by the movement support device 63 is moved close to the photoconductor unit 20, and then, the second end portions 70*b* of the connecting devices 7A, 7B that are attached to the attachment shafts 67 at both the end sides of the developing device 24 in the longitudinal direction D are placed on the securing surfaces 215 of the securing portions 20*h* of the photoconductor unit 20 (see FIG. 9A).

Here, regardless of whether the photoconductor unit 20 is connected to the developing device 24, as described above, the photoconductor unit 20 is mounted in a state in which the photoconductor drum 21 is positioned to the reference position E1 relative to the drawing movement body including, for example, the drawing frames 15A, 15B (see FIGS. 4 and 7).

Figure 11:
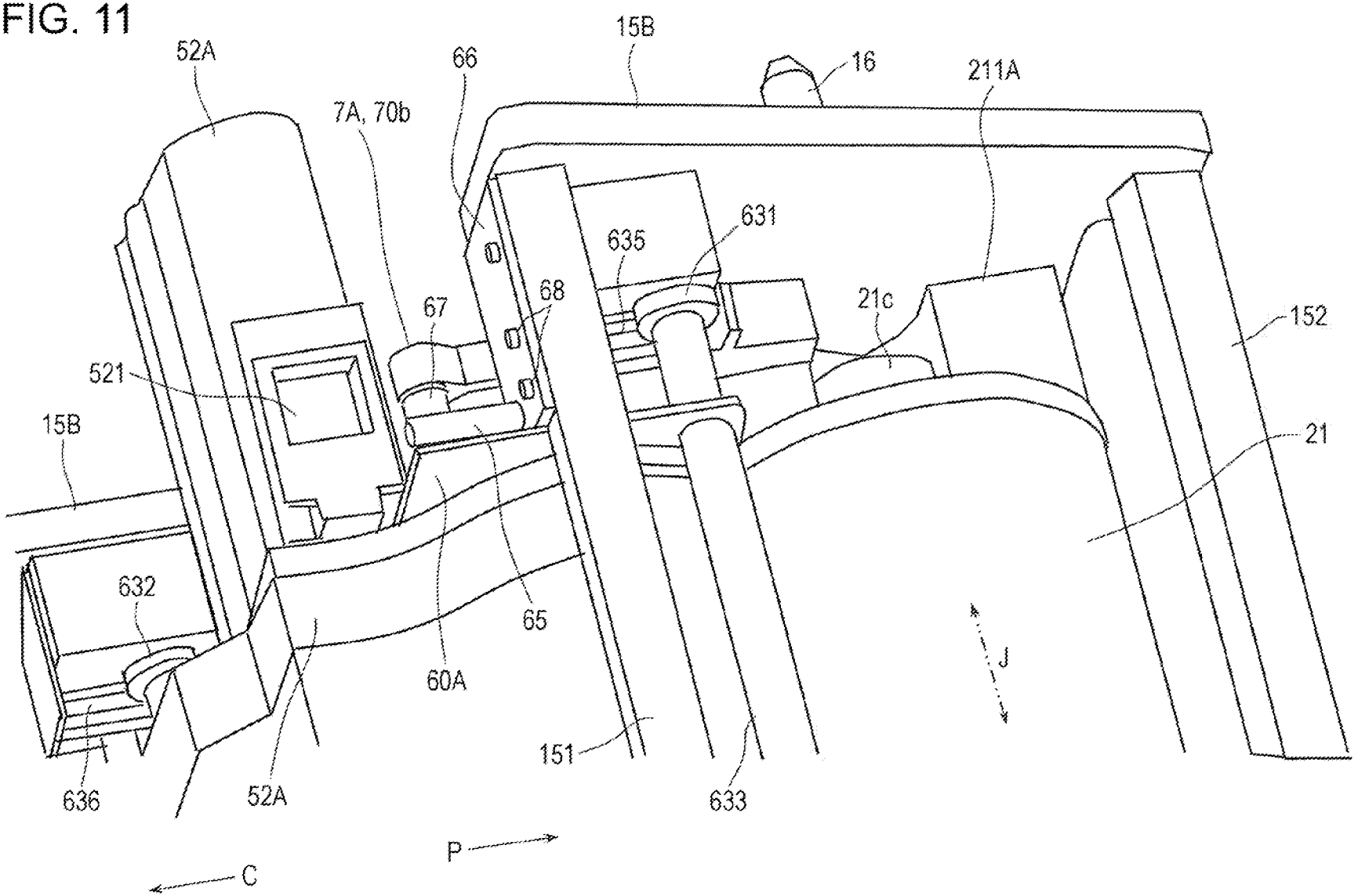
FIG. 11 is a schematic perspective view illustrating part of a state in which the photoconductor unit and the developing device are connected to each other.

Furthermore, as illustrated in FIG. 11, the developing device 24 having been moved close to the photoconductor unit 20 is kept pressed at the predetermined pressure F in the pressing direction P due to action of pressing devices 65.

Furthermore, a connection operation is performed in a state in which the drawing movement body on which the photoconductor unit 20, the developing device 24, and so forth are placed is drawn to the outside of the housing 10.

At this time, since the height positions of the securing surfaces 215 are substantially the same as the height of the centers of the attachment shafts 67 as described above, the members 70 of the connecting devices 7A, 7B elongated in a single direction are in a horizontal state as long as the securing surfaces 215 are flat surfaces in a horizontal state. In so doing, the connecting devices 7A, 7B may be inclined when there is a difference in height between the positions of the securing surfaces 215 and the centers of the attachment shafts 67 due to factors such as tolerances or differences between individual components. In this case, the inclined state when the connecting devices 7A, 7B are secured may be suppressed by displacing the first end portions in the long direction M of the long holes of the attachment holes 72 relative to the attachment shafts 67 in the connecting devices 7A, 7B.

Also at this time, the two unthreaded holes 73 provided in the second end portion 70*b* substantially face two threaded holes as the fitting holes 82 of the securing device 8 provided in the securing surface 215 of the securing portion 20*h* in each of the connecting devices 7A, 7B (see FIG. 9A). Thus, the screws are disposed at positions where tightening that corresponds to fitting by which the screws as the projections 81 of the securing device 8 are fitted into the threaded holes as the fitting holes 82 of the securing device 8 is able to be performed. In so doing, as described above, the developing device 24 is kept pressed against the photoconductor unit 20 by the pressing devices 65.

Thus, the screws as the projections 81 of the securing device 8 may be easily screwed into the threaded holes as the fitting holes 82 of the securing device 8. As a result, the connecting devices 7A, 7B may be easily secured to the securing portions 20*h* by the securing devices 8 when the developing device 24 is kept pressed against the photoconductor unit 20.

Next, after two screws as the projections 81 of the securing device 8 have been respectively inserted through two unthreaded holes 73 in each of the connecting devices 7A, 7B, these two screws are respectively fitted and screwed into two threaded holes as the fitting holes 82 provided in the securing surfaces 215.

Thus, as illustrated in FIG. 9B, the second end portion 70*b* of each of the connecting devices 7A, 7B is secured to the securing surface 215 of the photoconductor unit 20 by the securing device 8.

When the above-described operation has been performed, the developing device 24 and the photoconductor unit 20 are connected to each other by the connecting devices 7A, 7B as illustrated in FIGS. 2 to 4. This connection may be easily performed by screwing the screws as the projections 81 of the securing devices 8 for the connecting devices 7A, 7B.

The developing device 24 having been connected is kept pressed against the photoconductor unit 20 at the required pressure F by the pressing devices 65. In addition, while receiving the pressure F, the contact portions 62 of the space maintaining members 61 are pressed against the contact surfaces 214 of the respective shaft support portions 211A, 211B. Thus, when the connection by the connecting devices 7A, 7B is completed, the space S between the developing roller 57 of the developing device 24 and the photoconductor drum 21 may be maintained at a wished distance set by the space maintaining members 61.

Also at this time, since the developing device 24 is connected to the photoconductor unit 20 by the connecting devices 7A, 7B, the positional relationship between the developing device 24 and the photoconductor unit 20 is substantially fixed. Accordingly, even when operating vibration of the developing device 24 or the like is generated in the image forming operation, the positional relationship is not necessarily varied between the developing device 24 and the photoconductor unit 20 due to influence of the vibration.

Furthermore, in this image forming apparatus 1, when an operation such as checking or replacement of the photoconductor drum 21, the developing device 24, or the like is performed, it is required that the connection between the photoconductor unit 20 and the developing device 24 be released.

In this case, as illustrated in FIGS. 6 and 7, the connection is released by removing the screws as the projections 81 of the securing devices 8 so as to release the securing of the connecting devices 7A, 7B to the securing surfaces 215 of the photoconductor unit 20. As is the case with the connection operation, this operation for releasing the connection is also performed in a state in which the drawing movement body on which the photoconductor unit 20, the developing device 24, and the like are place is drawn out of the housing 10.

When the connection is released, as illustrated in FIGS. 6 and 7, the developing device 24 supported by the movement support device 63 becomes movable in the direction C in which the developing device 24 is separated from the photoconductor unit 20. Thus, developing device 24 and the photoconductor unit 20 are able to be kept separated from each other. Furthermore, after this separated state has been assumed, for example, the photoconductor unit 20 or the developing device 24 is able to be removed and subjected to operation such as replacement.

In this regard, when the connection by the connecting devices 7A, 7B is released, the pressing of the developing device 24 by the pressing devices 65 is able to be released by, for example, releasing the securing state of the attachment plates 66 to the respective end portions of the connecting member 151. Thus, it is not required that an operation to move the developing device 24 in the direction C in which the developing device is separated from the photoconductor unit 20 be performed against the pressing by the pressing devices 65.

Furthermore, the photoconductor unit 20 and the developing device 24 may be easily reconnected by repeating the above-described connection operation by the connecting devices 7A, 7B in a similar manner.

As has been described, compared to the case where the developing device 24 and the photoconductor unit 20 are not connected to each other by the removably secured connecting devices 7A, 7B, this image forming apparatus 1 may suppress variation of the space S between the developing roller 57 of the developing device 24 and the photoconductor drum 21 due to operating vibration generated in the developing device 24 and so force in, for example, the image forming operation.

Accordingly, the image forming apparatus 1 may suppress degradation of image quality due to variation of the space S between the developing roller 57 and the photoconductor drum 21 caused by vibration. Furthermore, in this image forming apparatus 1, the space S may be easily set when the developing device 24 and the photoconductor unit 20 are connected to each other by securing the connecting devices 7A, 7B.

Furthermore, in this image forming apparatus 1, also in the case of reconnection, the connection operation by the connecting devices 7A, 7B is completed with the developing device 24 kept pressed by the pressing devices 65. Thus, the space S between the developing roller 57 and the photoconductor drum 21 may be easily maintained at a fixed distance by the space maintaining members 61, and operation for adjustment of the space S is not necessarily required.

Furthermore, in the image forming apparatus 1, the direction K in which the securing devices 8 secure the connecting devices 7A, 7B is set so as to intersect the pressing direction P of the pressing devices 65 (see FIG. 9B). Thus, compared to the case where securing devices 8 that are not set as described above are employed, the space S between the developing roller 57 and the photoconductor drum 21 maintained by the space maintaining members 61 may be maintained in a good manner without the possibility of even a slight variation due to shifting by, for example, securing of the securing devices 8 in an inclined direction. Such a result may further more reliably obtained as the angle between the direction K of securing by the securing devices 8 and the pressing direction P becomes or becomes close to the right angle as much as possible.

Furthermore, in this image forming apparatus 1, even when the connecting devices 7A, 7B are inclined due to factors such as tolerances in securing the connecting devices 7A, 7B by using the securing devices 8, the inclined state may be suppressed by displacing the first end portions of the connecting devices 7A, 7B in the long direction M of the long holes of the attachment holes 72 relative to the attachment shafts 67. Furthermore, securing in a deformed state by forcibly securing the inclined connecting devices 7A, 7B by using the securing devices 8 may also be avoided.

Furthermore, in this image forming apparatus 1, the long direction M of the long holes of the attachment holes 72 of the connecting devices 7A, 7B are parallel to the direction K in which the securing devices 8 secure the connecting devices 7A, 7B. Accordingly, the space S between the developing roller 57 and the photoconductor drum 21 may be stably maintained without the possibility of variation due to, for example, displacement of the developing device 24 caused by securing of the connecting devices 7A, 7B by using the securing devices 8.

Furthermore, in this image forming apparatus 1, each of the connecting devices 7A, 7B is configured such that the virtual line VL that passes through the center Oa of the portion for attachment to the developing device 24 and the center Ob of the portion secured to the securing portion 20*h* (second end portion 70*b*) is parallel to the direction C of the separation due to the movement by using the movement support device 63. Accordingly, despite the fact that the developing device 24 is supported such that the developing device 24 is movable in the direction C in which the developing device is separated from the photoconductor unit 20, the space S between the developing roller 57 of this developing device 24 and the photoconductor drum 21 may be easily set by connecting the connecting devices 7A, 7B, and variation in space S due to vibration may be suppressed.

Furthermore, in this image forming apparatus 1, the left and right end portions of the photoconductor unit 20 in the longitudinal direction D and the left and right end portions of the developing device 24 in the longitudinal direction are respectively connected to each other by two connecting devices 7A, 7B. Thus, compared to the case where only one of the left and right end portions is connected by a connecting device 7, the space between the developing roller 57 and the photoconductor drum 21 may be easily set in the axial direction J, and variation of the space S due to vibration may be more reliably suppressed. Furthermore, since adjustment required for the space S is performed by the adjusting devices 612 of the space maintaining members 61, the space S may be more accurately maintained.

In addition, in the image forming apparatus 1, operating vibration of the transport members or the like may increase if the amount of the developer 18 to be used is increased due to an increase in size of the entirety of the developing device 24 or employing of a structure in which the dimension of the developing device 24 is increased in the longitudinal direction D. In other case, when a user draws the image making device 2 from the image forming apparatus 1 to conduct work such as attaching or removing, the image making device 2 may vibrate. Even in such cases, since the photoconductor unit 20 and the developing device 24 are connected to each other by the connecting devices 7A, 7B, variation of the space S between the developing roller 57 and the photoconductor drum 21 due to reception of the operating vibration may be suppressed.

Also in these cases, a measure to increase the pressure produced by pressing performed by the pressing devices 65 is not necessarily taken to suppress the variation of the space S due to operating vibration. This may suppress deformation of or damage to the components in, for example, the developing device 24 which would otherwise be deformed or damaged by receiving strong pressure from the pressing devices 65 applying increased pressure.

OTHER EXEMPLARY EMBODIMENTS

According to the first exemplary embodiment described above, as each of the connecting devices 7, a structure is described in which the second end portion 70*b* is brought into contact with the substantially horizontal securing surface 215 disposed in an upper portion of the shaft support portion 211 in the photoconductor unit 20 and, in this state, secured to the securing surface 215 from above to below by using the securing device 8. However, the connecting devices 7 are not limited to this and may have other structures as exemplified below.

For example, the connecting device 7 may have a structure in which the second end portion 70*b* is brought into contact with, from side, a securing surface formed in a side surface portion of the shaft support portion 211 in the photoconductor unit 20 and, in this state, secured to the securing surface from side, for example, horizontally by using the securing device 8. However, vibration in a direction perpendicular to the axial direction J of (the shaft portion 21*c* of) the photoconductor drum 21 generated by rotation of the photoconductor drum 21 or vibration in a direction perpendicular to the axial direction of the (shaft portion 57*c*) of the developing roller 57 generated by rotation of the developing roller 57 may be suppressed more with the connecting device 7 secured from above to below by using the securing device 8.

Alternatively, the connecting device 7 may have a structure in which the second end portion 70*b* is brought into contact with a securing surface formed in a side surface portion of the shaft support portion 211 including an inclined surface in the photoconductor unit 20 in an inclined direction corresponding to the inclined surface and, in this state, secured to the securing surface so as to face the inclined direction by using the securing device 8.

Both the first and second end portions 70*a*, 70*b* of the connecting device 7 may be secured by using removable securing device 8.

Alternatively, the connecting device 7 may be fixedly attached to part of the housing 50 of the developing device 24 at the first end portion 70*a* or integrally produced as part of the housing 50.

Other than the above description, the number, the shape, and so forth of the connecting device 7 may be changed. The attachment hole 72 of the connecting device 7 may have a normal circular hole instead of the long hole.

The structure of the attachment shaft 67 onto which the attachment hole 72 is fitted may also be changed corresponding to the types of the connecting device 7. For example, a different structure may be employed for the sectional shape, projecting direction, and so forth of the attachment shaft 67.

The securing device 8 is not limited to the fitting device that is a combination of the projection 81 being a screw and the fitting hole 82 being a threaded hole. For example, securing device 8 may be a fitting device that is a combination of the projection 81 literally being a projecting portion and the fitting hole 82 being a fitting hole to be fitted onto the projecting portion.

The projection 81 including the projecting portion in this case is provided in the securing portion 20*h* of the photoconductor unit 20. However, this projecting portion may be provided in the second end portion 70*b* of the connecting device 7. As the other element of the fitting device, the fitting hole 82 is provided in the second end portion 70*b* of the connecting device 7. However, the fitting hole 82 may be provided in the securing portion 20*h* of the photoconductor unit 20. In this case, a separation suppressing device (such as shapes unlikely to be separated or securing with a screw or pin) may be employed for the projection 81 and the fitting hole 82.

The securing device 8 may be a device in the form other than the fitting device.

According to the first exemplary embodiment described above, as the example of the space maintaining device, the space maintaining members 61 are provided in the developing device 24. However, each of the space maintaining members may be provided in the photoconductor unit 20. In this case, a free end portion (another end portion) of the space maintaining member is brought into contact with a shaft support portion that supports the shaft portion 57*c* of the developing roller 57 and secured to the shaft support portion by using the securing device 8. In this case, the space maintaining member may be rotatably provided in the photoconductor unit 20.

According to the first exemplary embodiment described above, the first end portion 70*a* of the member 70 included in each of the connecting devices 7A, 7B is pivotally attached to the developing device 24, and the second end portion 70*b* is secured to the securing portion 20*h* of the photoconductor unit 20 by using the removable securing device 8. Furthermore, the photoconductor unit 20 is mounted by being held in a state in which the photoconductor drum 21 is positioned to the reference position E1 relative to the drawing movement body including, for example, the drawing frames 15A, 15B.

Accordingly, the connecting devices 7A, 7B may be structured such that the first end portions 70*a* of the members 70 included in the connecting devices 7A, 7B are secured by using the removable securing devices 8 to the drawing frames 15A, 15B, which are disposed in the housing 10 so as to be able to be drawn to the outside, or a connecting member (frame) that connects the drawing frames 15A, 15B to each other.

Furthermore, according to the first exemplary embodiment described above, as the image forming apparatus 1, an image forming apparatus of a type forming monochrome images is described as the example. However, as long as the structure in which the photoconductor unit 20 and the developing device 24 are connected to each other by the connecting device 7 is applicable, an image forming apparatus of, for example, a different type (for example, any of an image forming apparatus of a type forming multi-color images, an image forming apparatus to which an intermediate transfer body is applied, and so forth) may be employed. In the case of an image forming apparatus that forms multi-color images, as the photoconductor unit 20 and the developing device 24, a plurality of photoconductor units 20 and a plurality of developing devices 24 required to reproduce colors of multi-color images are provided.

Furthermore, the developing device 24 may be a developing device of a different type as long as connection to the photoconductor unit 20 by the connecting device 7 is effective.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a photoconductor unit that includes a photoconductor and a first part;

a developing device that includes a developing roller and a second part;

a space maintaining device that has a third part, that is provided in the photoconductor unit or the developing device, and that is brought into contact with the first part or the second part at the third part so as to maintain a space between the developing roller and the photoconductor;

a pressing device that presses the developing device toward the photoconductor unit;

a removable securing device; and at least one connecting device that secures the photoconductor unit and the developing device by using the securing device so as to connect the photoconductor unit and the developing device to each other, wherein the photoconductor unit and developing device are configured to form an image when the securing device is removed.

2. The image forming apparatus according to claim 1, wherein a direction in which the securing device secures the at least one connecting device intersects a direction in which the pressing device presses.

3. The image forming apparatus according to claim 2, wherein the direction in which the securing device secures the at least one connecting device intersects an axial direction of the photoconductor.

4. The image forming apparatus according to claim 3, wherein the photoconductor unit has a securing portion, and the at least one connecting device has a first end portion that is pivotally attached to the developing device and a second end portion that is secured to the securing portion by the securing device.

5. The image forming apparatus according to claim 4, wherein the at least one connecting device has an attachment hole provided in the first end portion, and the developing device has an attachment shaft, the at least one connecting device is pivotally attached to the attachment shaft at the attachment hole, and the attachment hole is an elongated long hole that allows displacement in a direction in which an inclined state assumed when the at least one connecting device is secured is suppressed.

6. The image forming apparatus according to claim 5, wherein a long direction of the long hole of the at least one connecting device is parallel to the direction in which the securing device secures.

7. The image forming apparatus according to claim 2, wherein the photoconductor unit has a securing portion, and the at least one connecting device has a first end portion that is pivotally attached to the developing device and a second end portion that is secured to the securing portion by the securing device.

8. The image forming apparatus according to claim 7, wherein the at least one connecting device has an attachment hole provided in the first end portion, and the developing device has an attachment shaft, the at least one connecting device is pivotally attached to the attachment shaft at the attachment hole, and the attachment hole is an elongated long hole that allows displacement in a direction in which an inclined state assumed when the at least one connecting device is secured is suppressed.

9. The image forming apparatus according to claim 8, wherein a long direction of the long hole of the at least one connecting device is parallel to the direction in which the securing device secures.

10. The image forming apparatus according to claim 1, wherein the photoconductor unit has a securing portion, and the at least one connecting device has a first end portion that is pivotally attached to the developing device and a second end portion that is secured to the securing portion by the securing device.

11. The image forming apparatus according to claim 10, wherein the at least one connecting device has an attachment hole provided in the first end portion, and the developing device has an attachment shaft, the at least one connecting device is pivotally attached to the attachment shaft at the attachment hole, and the attachment hole is an elongated long hole that allows displacement in a direction in which an inclined state assumed when the at least one connecting device is secured is suppressed.

12. The image forming apparatus according to claim 11, wherein a long direction of the long hole of the at least one connecting device is parallel to a direction in which the securing device secures.

13. The image forming apparatus according to claim 12, wherein the photoconductor has a shaft portion, and the securing portion is a support device that supports the shaft portion.

14. The image forming apparatus according to claim 11, wherein the photoconductor has a shaft portion, and the securing portion is a support device that supports the shaft portion.

15. The image forming apparatus according to claim 10, wherein the photoconductor has a shaft portion, and the securing portion is a support device that supports the shaft portion.

16. The image forming apparatus according to claim 10, further comprising:

a movement support device that supports the developing device such that the developing device is movable in a direction in which the developing device is separated from the photoconductor unit, wherein the at least one connecting device has a portion attached to the developing device, and the portion attached to the developing device has a first center, the at least one connecting device has a portion secured to the securing portion, and the portion secured to the securing portion has a second center, and a line passing through the first center and the second center is parallel to the direction in which the developing device is separated due to a movement by using the movement support device.

17. The image forming apparatus according to claim 1, wherein the securing device is a fitting device that has a projection and a fitting hole which are removably fitted to each other, and one of the fitting hole and the projection is disposed at a position where the one of the fitting hole and the projection faces and is able to be fitted to another of the fitting hole and the projection when the developing device is pressed toward the photoconductor unit by the pressing device.

18. The image forming apparatus according to claim 1, wherein the space maintaining device includes an adjusting device that adjusts the space.

19. The image forming apparatus according to claim 1, wherein the at least one connecting device includes a plurality of connecting devices, the photoconductor unit has a left end portion and a right end portion in a longitudinal direction, wherein the developing device has a left end portion and a right end portion in the longitudinal direction, and the plurality of connecting devices respectively connect the left end portion of the photoconductor unit and the left end portion of the developing device to each other and the right end portion of the photoconductor unit and the right end portion of the developing device to each other.

20. An image forming apparatus comprising:

a photoconductor unit that includes a photoconductor and a first part;

a frame that holds the photoconductor unit;

a developing device that includes a developing roller and a second part;

a space maintaining device that has a third part, that is provided in the photoconductor unit or the developing device, and that is brought into contact with the second part or the first part at the third part so as to maintain a space between the developing roller and the photoconductor;

a pressing device that presses the developing device toward the photoconductor unit;

a removable securing device; and a connecting device that secures the frame and the developing device by using the securing device so as to connect the frame and the developing device to each other.

* * * * *